US009614338B2

(12) United States Patent
Alexander et al.

(10) Patent No.: US 9,614,338 B2
(45) Date of Patent: Apr. 4, 2017

(54) POWER MODULE HAVING MULTIPLE POWER RECEPTACLES

(71) Applicant: HERMAN MILLER, INC., Zeeland, MI (US)

(72) Inventors: Brian Alexander, Douglas, MI (US); Peter Keyzer, Zeeland, MI (US); Michael Johnson, Grand Haven, MI (US); Lawrence W. Kallio, III, Grand Haven, MI (US); Jeffrey L. Clark, Holland, MI (US)

(73) Assignee: Herman Miller, Inc., Zeeland, MI (US)

( * ) Notice: Subject to any disclaimer, the term of this patent is extended or adjusted under 35 U.S.C. 154(b) by 208 days.

(21) Appl. No.: 14/296,996

(22) Filed: Jun. 5, 2014

(65) Prior Publication Data

US 2015/0009652 A1 Jan. 8, 2015

Related U.S. Application Data

(60) Provisional application No. 61/832,519, filed on Jun. 7, 2013.

(51) Int. Cl.
*H01R 35/04* (2006.01)
*H01R 25/00* (2006.01)
(Continued)

(52) U.S. Cl.
CPC ..... *H01R 35/04* (2013.01); *H01R 25/006* (2013.01); *A47B 2021/068* (2013.01); *H01R 13/717* (2013.01)

(58) Field of Classification Search
CPC .... H01R 35/04; H01R 25/006; H01R 13/717; A47B 2021/068
See application file for complete search history.

(56) References Cited

U.S. PATENT DOCUMENTS 4,372,629 A 2/1983 Propst et al.
4,551,577 A 11/1985 Byrne
(Continued)

OTHER PUBLICATIONS

Mho®—Byrne Electrical, https://www.byrne-electrical.com/Product/19/Mho, Sep. 2013, 2 pages.
(Continued)

*Primary Examiner* — Sharon Payne
(74) *Attorney, Agent, or Firm* — Michael Best & Friedrich LLP

(57) ABSTRACT

A power receptacle module for a work surface having multiple power receptacles includes a mounting frame configured to be received within an aperture in the work surface, a pivoting receptacle assembly pivotally mounted in the mounting frame and configured to pivot between a first orientation and a second orientation, relative to the mounting frame. The pivoting receptacle assembly has a flat face plate and a plurality of power receptacles fixedly mounted below the flat face plate. When the pivoting receptacle assembly is in the first orientation, the flat face plate is flush with a top surface of the work surface, and the plurality of power receptacles are hidden below the work surface. When the pivoting receptacle assembly is in the second orientation, the flat face plate is disposed at an oblique angle relative to the work surface, and the plurality of power receptacles are exposed.

27 Claims, 15 Drawing Sheets

(51) Int. Cl.
*H01R 13/717* (2006.01)
*A47B 21/06* (2006.01)

(56) References Cited

U.S. PATENT DOCUMENTS

| | | | | |
|---|---|---|---|---|
| 4,747,788 | A | 5/1988 | Byrne | |
| 4,984,982 | A * | 1/1991 | Brownlie | G02B 6/4451 174/490 |
| 5,575,668 | A | 11/1996 | Timmerman | |
| 5,964,618 | A | 10/1999 | McCarthy | |
| 6,028,267 | A | 2/2000 | Byrne | |
| 6,290,518 | B1 | 9/2001 | Byrne | |
| 6,488,540 | B2 | 12/2002 | Coyle, Jr. et al. | |
| 6,540,554 | B2 | 4/2003 | McCarthy | |
| 7,312,393 | B2 | 12/2007 | McCarthy | |
| 7,605,330 | B1 | 10/2009 | Black et al. | |
| 7,626,120 | B1 | 12/2009 | Golden et al. | |
| 7,901,224 | B1 | 3/2011 | Black et al. | |
| 8,082,856 | B1 | 12/2011 | Hayden et al. | |
| 8,119,910 | B1 | 2/2012 | Golden et al. | |
| D666,556 | S | 9/2012 | Byrne | |
| 8,287,292 | B2 * | 10/2012 | Byrne | H02G 3/185 439/131 |
| 8,317,537 | B1 | 11/2012 | Black et al. | |
| 8,480,415 | B2 | 7/2013 | Byrne | |
| 8,512,072 | B1 | 8/2013 | Black et al. | |
| 2005/0167138 | A1 | 8/2005 | McCarthy | |
| 2006/0146652 | A1 * | 7/2006 | Huizi | G04G 9/0076 368/107 |
| 2011/0230228 | A1 * | 9/2011 | Young | G08C 17/02 455/550.1 |
| 2014/0030910 | A1 * | 1/2014 | Carpanzano | H01R 13/74 439/501 |

OTHER PUBLICATIONS

ECA—Electri-Cable Assemblies—Innovative Power and Data Solutions, http://www.electri-cable.com, Sep. 2013, 2 pages.
Mho®—Byrne Electrical Specialists, Brochure, available before the filed of application, 2 pages.
AXIL X—Byrne Electrical Specialists, Brochure, available before the filed of application, 2 pages.

* cited by examiner 130
330
330

130
210
320
320
320
330
330

210
130
306
324
324
310
324

210
130
306
324
324
310
324

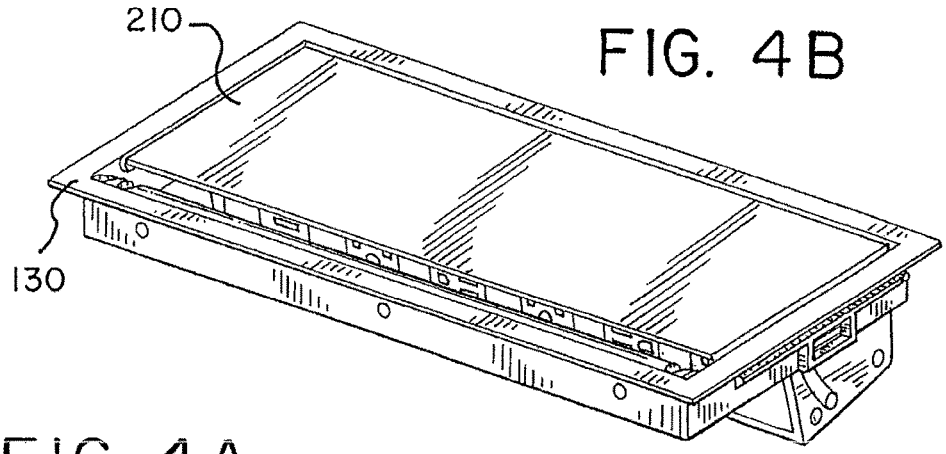
FIG. 4B
FIG. 4A
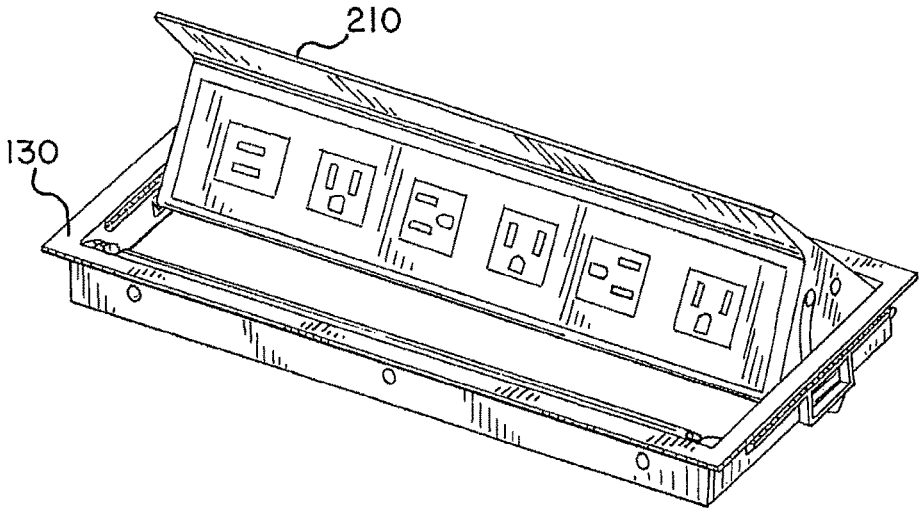
FIG. 4C
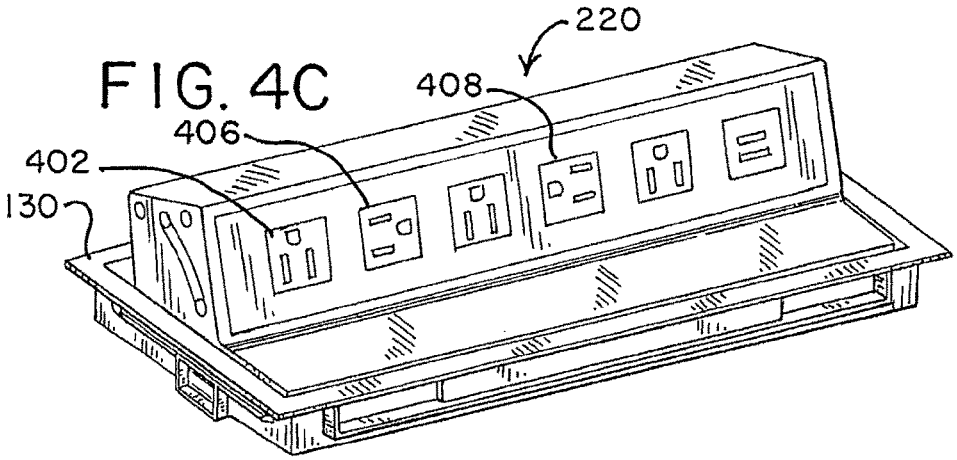

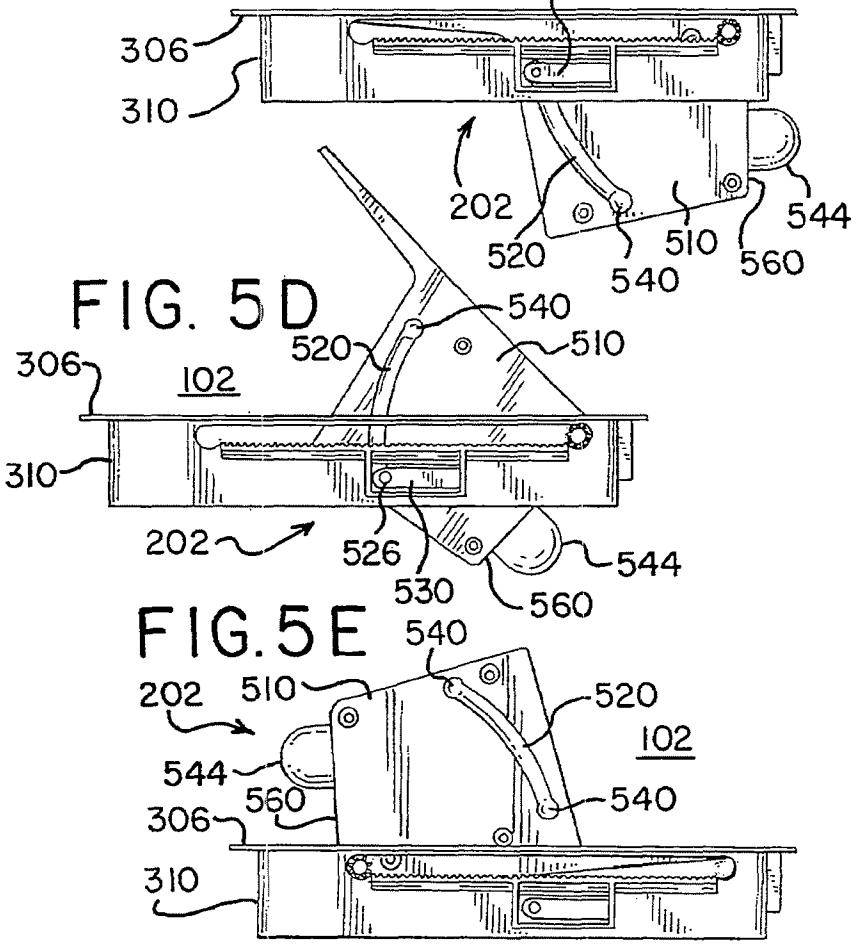
FIG. 5C
FIG. 5D
FIG. 5E
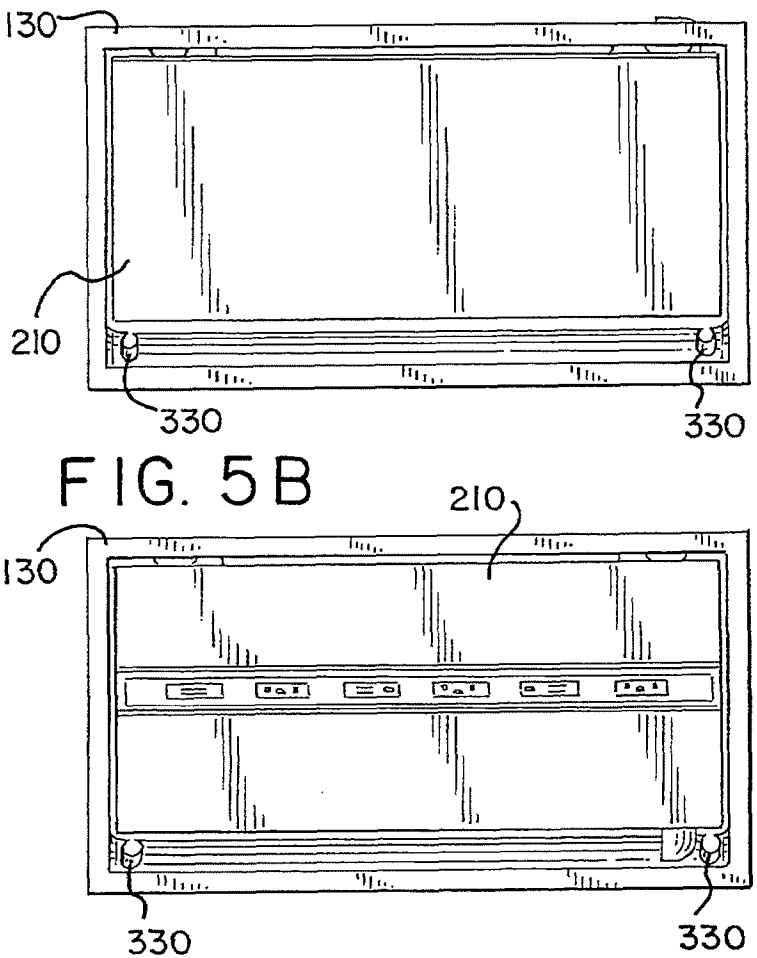
FIG. 5A
FIG. 5B

POWER MODULE HAVING MULTIPLE POWER RECEPTACLES

This application claims the benefit of U.S. Provisional Application Ser. No. 61/832,519, filed Jun. 7, 2013, the entire disclosure of which is hereby incorporated herein by reference.

TECHNICAL FIELD

This application relates generally power receptacles, and more particularly, to a multi-receptacle AC and/or DC power module for a work surface.

BACKGROUND

Computers and computer peripheral equipment are ubiquitous in the workplace. Work surfaces, such as desks, conference tables, work stations, and the like, are typically cluttered with external power strips into which such computers and peripheral equipment are connected. Often, power cords are draped over the edge of the work surface and plugged into AC sockets on the floor or under the table, and/or attach to extension cords. This creates an unsightly arrangement, which interrupts the otherwise open surface area of the work surface. Such power strips are particularly cumbersome and apparent on a work surface when no power plugs need be provided, such as when a person is working with paper only or desires an open uninterrupted work area.

SUMMARY

Certain embodiments of a power receptacle module for a work surface having multiple power receptacles and include a mounting frame configured to be received within an aperture in the work surface, a pivoting receptacle assembly pivotally mounted in the mounting frame and configured to pivot between a first orientation and a second orientation, relative to the mounting frame. The pivoting receptacle assembly has a flat face plate and a plurality of power receptacles fixedly mounted below the flat face plate. When the pivoting receptacle assembly is in the first orientation, the flat face plate is flush with a top surface of the work surface, and the plurality of power receptacles are hidden below the work surface. When the pivoting receptacle assembly is in the second orientation, the flat face plate is disposed at an oblique angle relative to the work surface, and the plurality of power receptacles are exposed.

In one aspect, one embodiment of a power receptacle module for a work surface includes a mounting frame configured to be received within an aperture in the work surface and a pivoting receptacle assembly pivotally mounted in the mounting frame and configured to pivot between a first orientation, a second orientation and a third orientation, relative to the mounting frame. The pivoting receptacle assembly includes a face plate and at least one power receptacle mounted below the face plate. When the pivoting receptacle assembly is in the first orientation, the face plate is substantially parallel with a top surface of the work surface, and the at least one power receptacle is hidden below the work surface. When the pivoting receptacle assembly is in the second orientation, the face plate is disposed at an acute angle relative to the work surface, and the at least one power receptacle is exposed above the work surface and is accessible from a first direction. When the pivoting receptacle assembly is in the third orientation, the face plate is disposed at an obtuse angle relative to the work surface, and the at least one power receptacle is exposed above the work surface and is accessible from a second direction opposite the first direction.

Other methods and systems, and features and advantages thereof will be, or will become, apparent to one with skill in the art upon examination of the following figures and detailed description. It is intended that the scope of the invention will include the foregoing and all such additional methods and systems, and features and advantages thereof.

BRIEF DESCRIPTION OF THE DRAWINGS

The components in the figures are not necessarily to scale, emphasis instead being placed upon illustrating various aspects thereof. Moreover, in the figures, like referenced numerals designate corresponding parts throughout the different views.

FIGS. 4A and 4C show AC power receptacles in a juxtaposed spaced relationship.

FIG. 4B shows the power receptacle module in a closed orientation.

FIGS. 5A-5B show the power receptacle module in a closed orientation with power cord grommets.

FIGS. 5C-5E show the pivoting configuration of the power receptacle module.

FIGS. 7A-8B show a back-to-back configuration.

FIGS. 8A-8B show a side view of the back-to-back configuration.

DETAILED DESCRIPTION

Figure 1A:
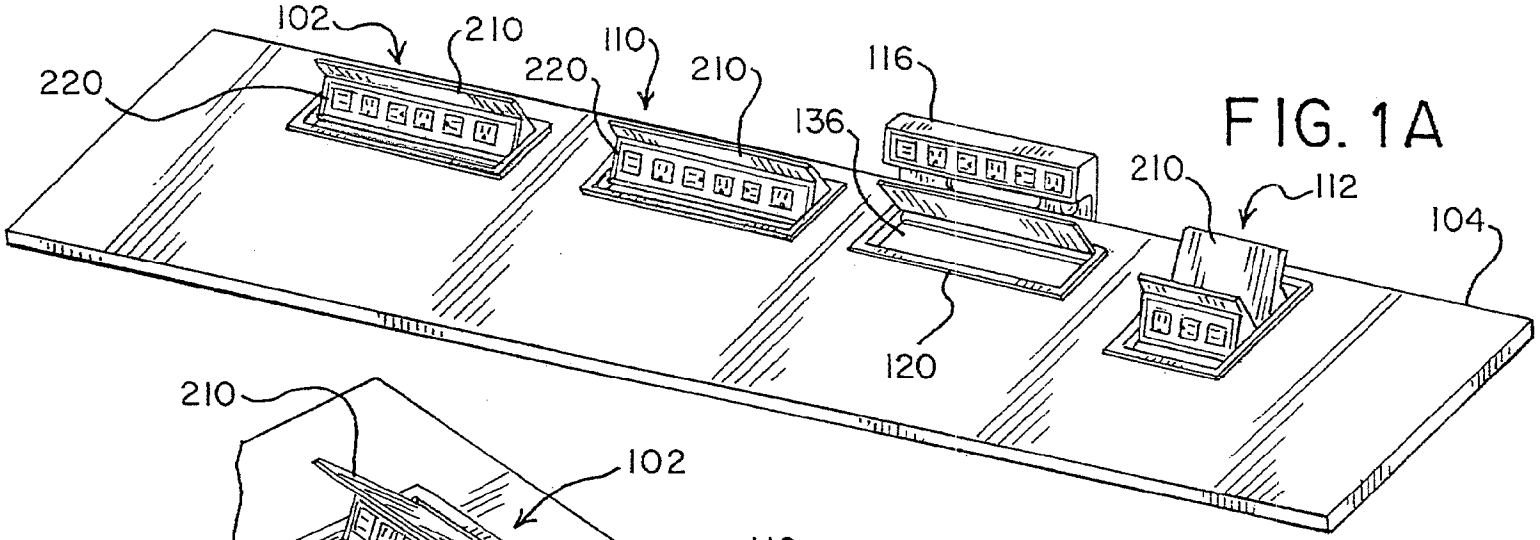
FIGS. 1A and 1B are perspective views of a power receptacle module mounted in a work surface according to one embodiment of the present invention.
Figure 1B:
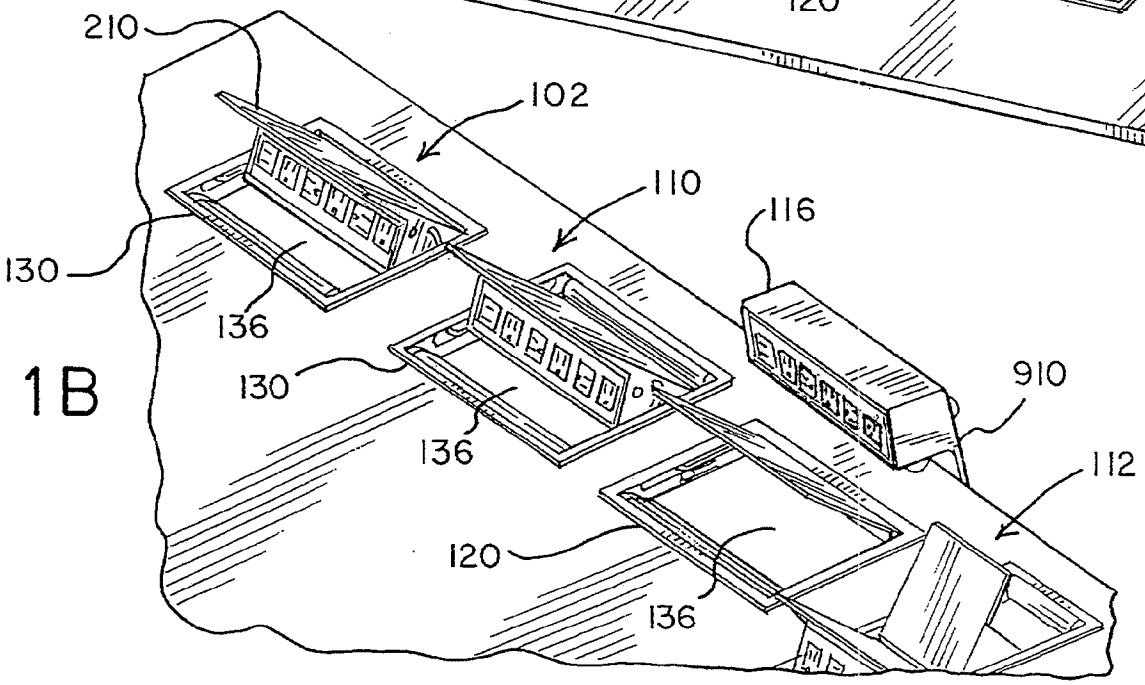

Referring to FIGS. 1A and 1B, a power receptacle module 102 for a work surface 104 is shown. In particular, four components are shown, namely a second power receptacle module 110, a back-to-back power receptacle module 112, and an upright power receptacle module 116. Also shown is a door 120 mounted in the work surface 104 without the power receptacle module. The work surface 104 may be a desk, work station, conference or other table, and the like.

Each power receptacle module 102 includes a mounting frame 130 configured to be received within an aperture 136 in the work surface 104. Preferably, the aperture is rectangular in shape. For purposes of clarity, the power receptacle module 102 will be referred to using only reference numeral 102 rather than all of the corresponding reference numbers for the power receptacles 102, 110, 112.

Figure 10A:
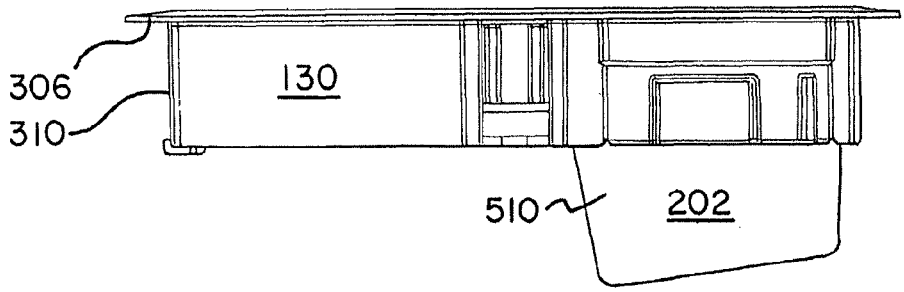
FIGS. 10A-C show an alternative embodiment of a power receptacle module in first, second and third orientations respectively.
Figure 10B:
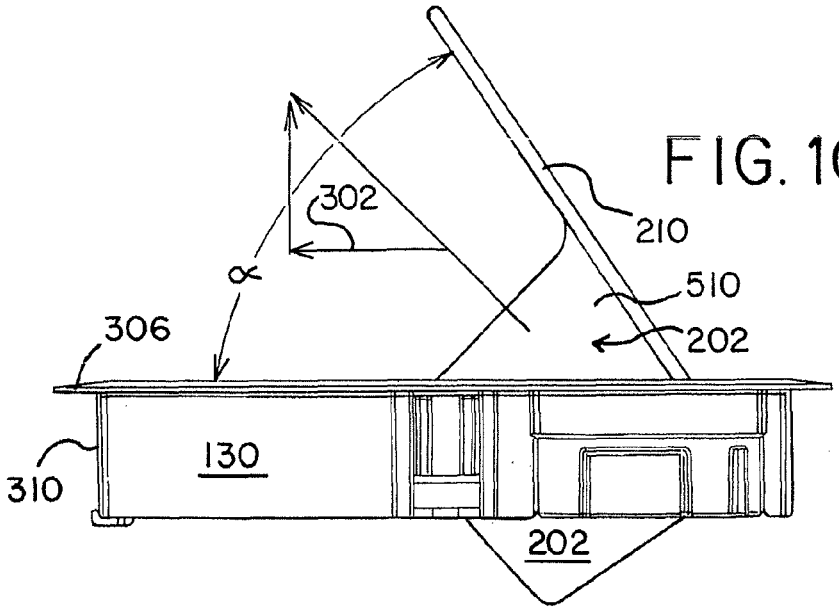
Figure 10C:
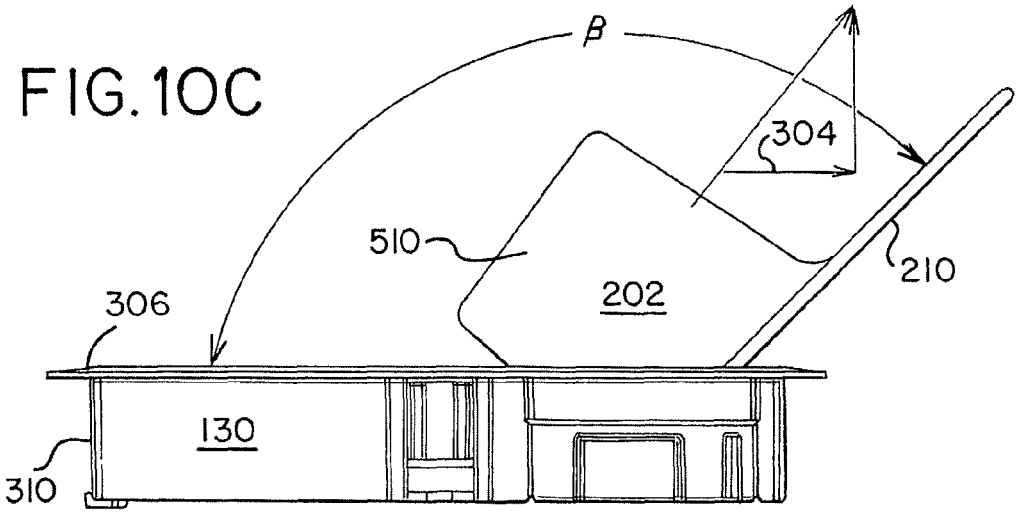

Referring to FIGS. 1A-1B in conjunction with FIGS. 2A-2C, 3A-3C, 4A-4B, and 10A and B, the power receptacle module 102 includes a pivoting receptacle assembly 202 pivotally mounted in the mounting frame 130. The pivoting receptacle assembly 202 includes a flat face plate 210 and a plurality of power receptacles 220 fixedly mounted below the flat face plate 210. It should be understood that the face plate may be curved, or have curved portions or other openings, for example to match a corresponding non-planar worksurface. The face plate may also include a recess for holding accessories such as paperclips and other personal items, but has portions lying in and defining a plane. The pivoting receptacle assembly 202 is configured to pivot between a first or closed orientation, shown in FIGS. 2A, 2C, and 4B, and a second or open orientation, shown in FIGS. 2B, 2D, and 4A, relative to the mounting frame 130. Referring to FIGS. 10A-C, the receptacle assembly 202 may also pivot to a third orientation.

Figures 3A, 3B, 3C, 3D:
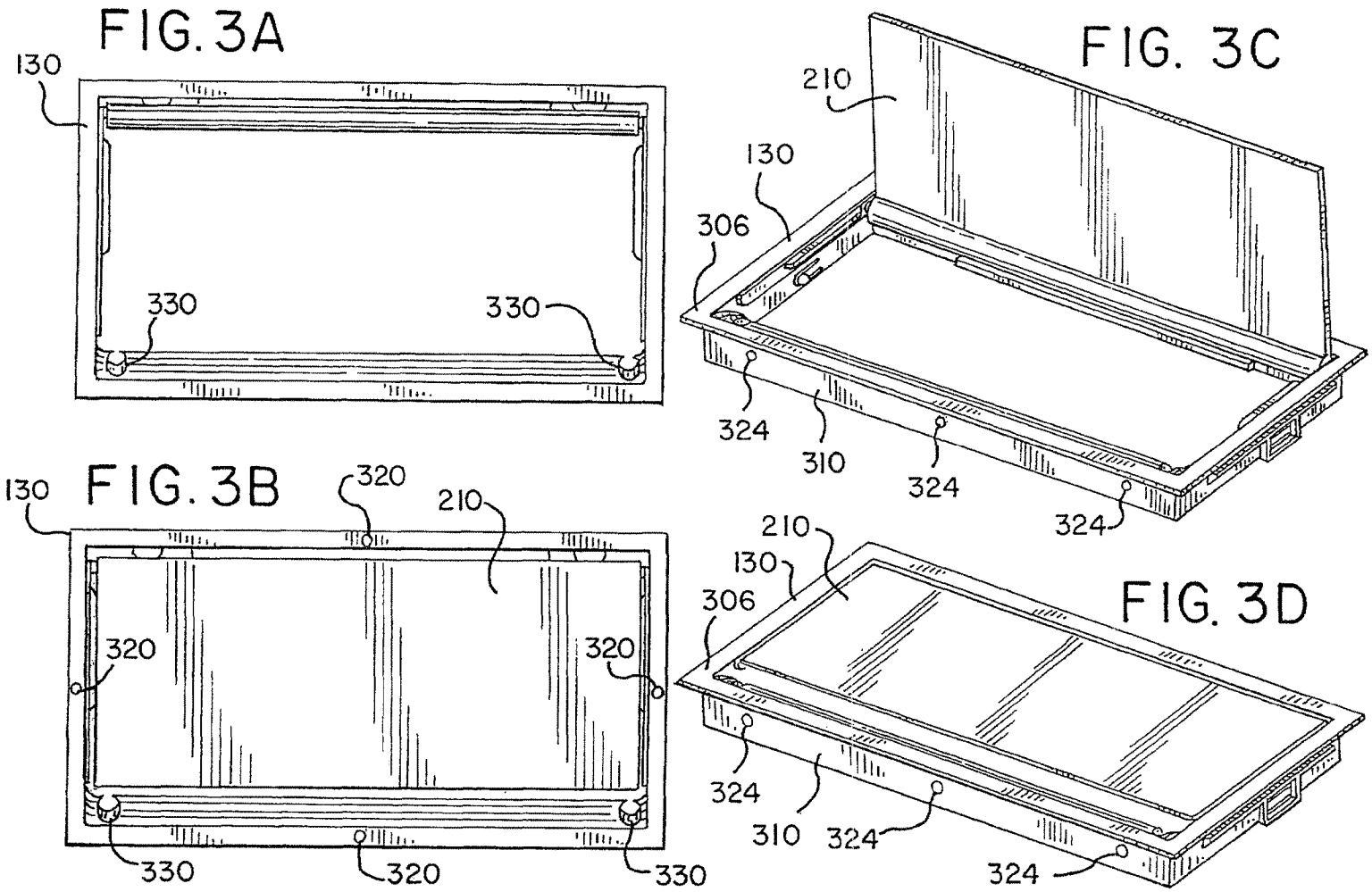
FIGS. 3A-3D show a mounting frame and face plate of the power receptacle module.

FIGS. 3A-3D show the mounting frame 130 without the pivoting receptacle assembly 202, whereas FIGS. 3B-3D also show the mounting frame 130 without the pivoting receptacle assembly 202, but do show the flat face plate 210. FIG. 3A shows the mounting frame 130 only.

When the pivoting receptacle assembly 202 is in the first orientation, the flat face plate 210 is parallel to, and in one embodiment flush with, a top surface of the work surface 104, and the plurality of power receptacles 220 are hidden below the work surface 104. In this closed configuration, the surface area of the work surface 104 is clean, unobstructed, and uninterrupted by unsightly power strips and the like.

Conversely, when the pivoting receptacle assembly 202 is in the second orientation, the flat face plate 210 is disposed at an oblique angle a relative to the work surface 104, and the plurality of power receptacles 220 are exposed and generally oriented such that they have a vector oriented in a first direction 302 parallel to the worksurface. In this open configuration, the user may plug in a variety of power cords into the plurality of power receptacles 220. For example, referring to FIGS. 10B and 11A and B, the face plate 210 may be oriented at an acute angle a relative to the worksurface. In one embodiment, 15 degrees$<\alpha<$90 degrees. In another embodiment, 30 degrees$\leq\alpha\leq$60 degrees. In another embodiment, $\alpha$ equal to about 45 degrees. It should be understood that the receptacle assembly 202 may be positioned or disposed at a plurality of second orientations, and maintained in those orientations as further explained herein.

Figure 12A:
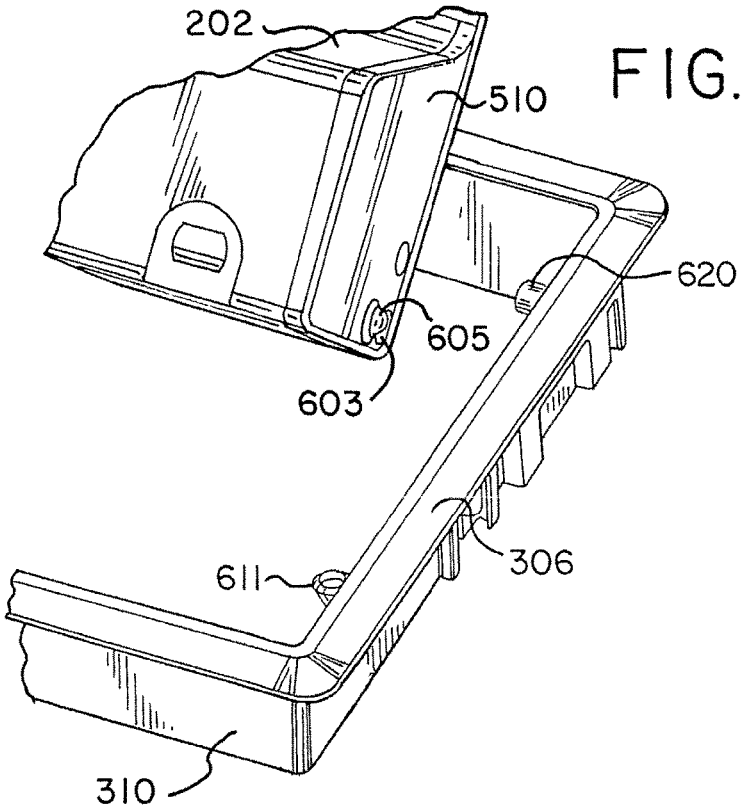
FIGS. 12A and B, show partial exploded views of the power receptacle and mounting frame in a third orientation.
Figure 12B:
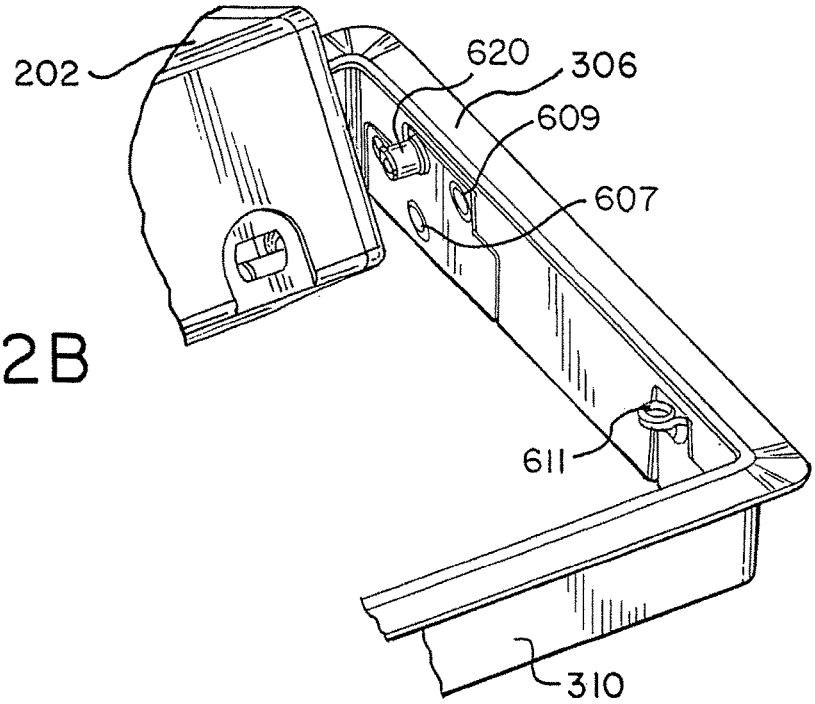

When the pivoting receptacle assembly 202 is in the third orientation, as shown in FIGS. 100 and 12A and B, the flat face plate 210 is disposed at an oblique angle $\beta$ relative to the work surface 104, and the plurality of power receptacles 220 are exposed and generally oriented such that they have a vector oriented in a second direction 304 parallel to the worksurface but opposite to the first direction 302. In this open configuration, the user may plug in a variety of power cords into the plurality of power receptacles 220 from an opposite side of the worksurface than when the receptacle assembly is in the second orientation. For example, referring to FIGS. 100 and 12A and B, the face plate 210 may be oriented at an obtuse angle $\beta$ relative to the worksurface. In one embodiment, 90 degrees$<\beta<$165, while in another embodiment, 120 degrees$\leq\beta\leq$150 degrees. In another embodiment, $\beta$ equal to about 135 degrees. It should be understood that the receptacle assembly 202 may be positioned or disposed at a plurality of third orientations, and maintained in those orientations as further explained herein.

Although the figures show that the plurality of power receptacles 220 as standard US-type AC power receptacles, they are shown in this manner for purposes of clarity only. Alternatively, the plurality of power receptacles 220 may be DC or USB-type receptacles that provide power and communication facilities to a computer or computer peripheral. Further, the plurality of power receptacles 220 may be a combination of AC power receptacles and DC or USB-type receptacles. Any suitable combination may be provided.

FIG. 4C shows a slightly enlarged view of a plurality of AC power receptacle 402, 406, and 408 of the plurality of power receptacles 220. Each of the AC power receptacles 402, 406, and 408 may be arranged in a juxtaposed spaced relation to each other to maximize a number of power cords, transformer modules, and/or international-standard plugs able to be received therein without physical blockage or interference. In one embodiment each AC power receptacle 402, 406, and 408 may be rotated ninety degrees relative to an adjacent AC power receptacle. The tends to maximize the total number of power cords, transformer modules, and/or international-standard plugs that can be accommodated due to size, bulk or particular geometry of the cord or transformer module to be plugged in.

Figures 2A, 2B, 2C, 2D:
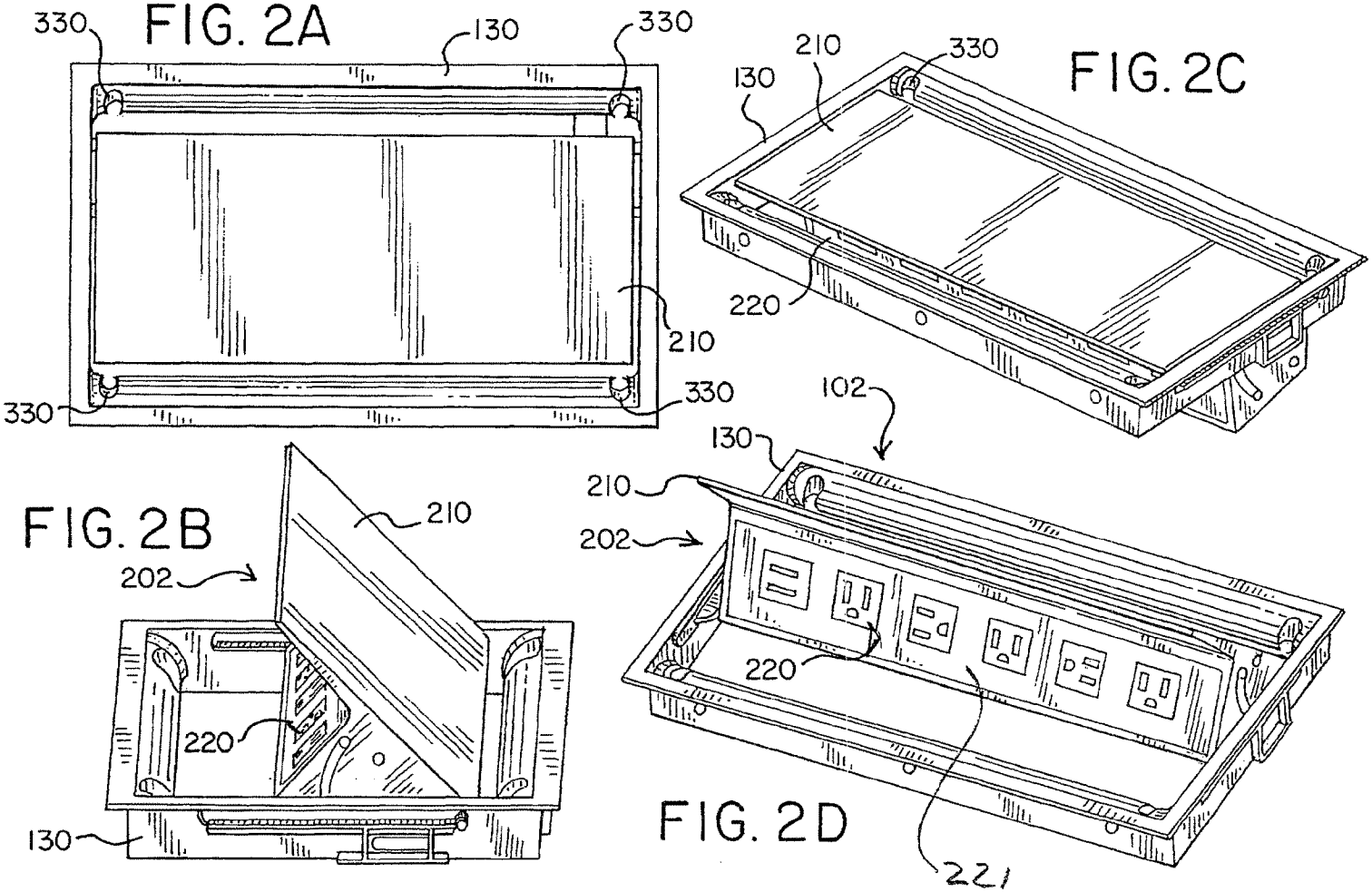
FIGS. 2A and 2C show the power receptacle module in a closed orientation.
FIGS. 2B and 2D show the power receptacle module in an open orientation.
Figure 11A:
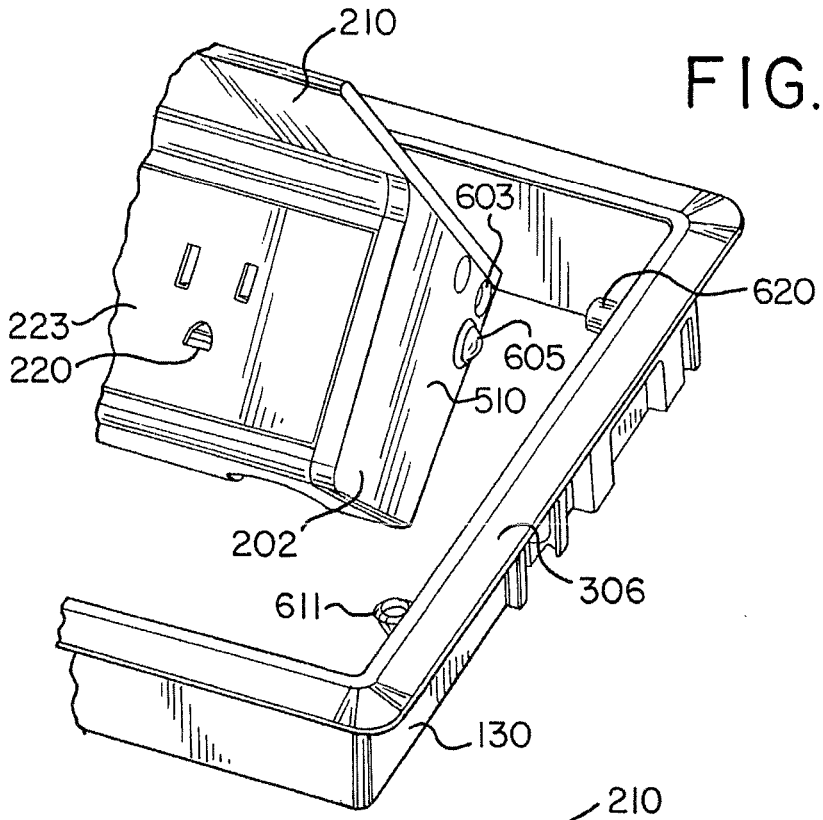
FIGS. 11A and B, show partial exploded views of the power receptacle and mounting frame in a second orientation.
Figure 11B:
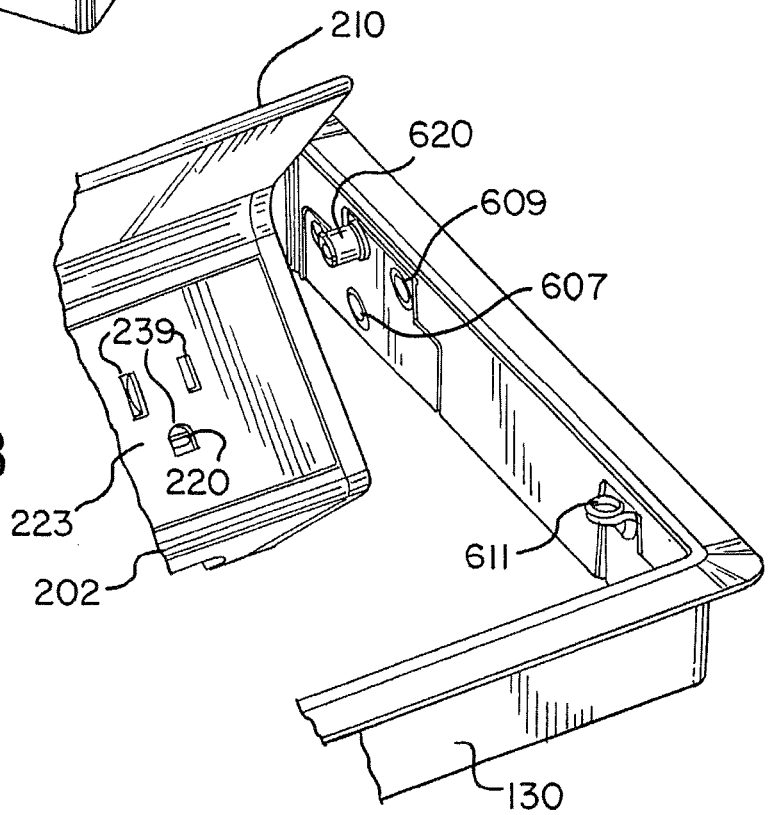

Referring to FIGS. 1A-B, 2B and D, 4A and C, and 9 B and C, the power receptacles 220, 402, 406 and 408 may have a forwardmost surface exposed to the user, with a cover plate 221 surrounding the faces of the receptacles. Alternatively, as shown in FIGS. 11A and B, 15 and 16, the cover plate 223 may extend over and cover the faces of the receptacles, 220, 402, 406, 408, with the cover plate 223 having openings 239 aligned with the openings 237 of the receptacles 220, 402, 406 and 408.

Figure 15:
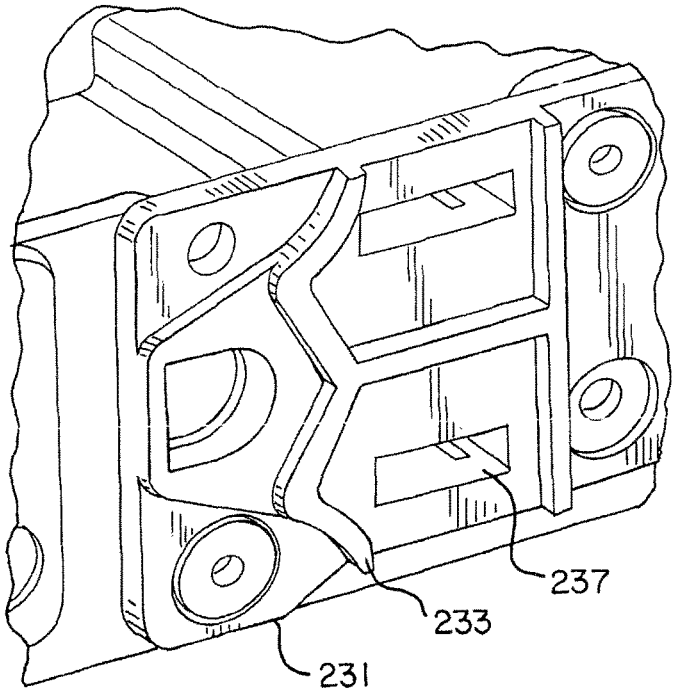
FIG. 15 is a partial perspective view of the front of a power receptacle.
Figure 18:
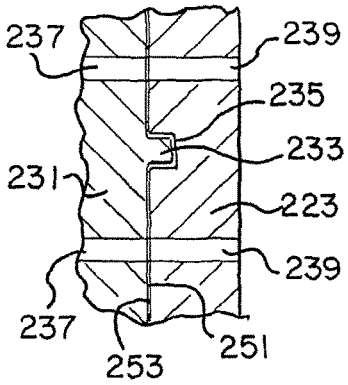
FIG. 18 is a cross-section view showing the interface between a power receptacle and cover plate.

Referring to FIGS. 15 and 18, a power receptacle 231 may be configured with a forwardly protruding rib 233. In one embodiment, the rib 233 defines the forwardmost surface of the power receptacle. The rib 233 may take the form of an anchor shape, or I-shape with a central portion, and opposite end portions, whether linear or angled, that surround each receptacle opening on at least three sides. In an alternative embodiment, the rib 233 may surround the entire periphery of each opening 237. Referring to FIG. 18, the rib 233 is received in a matingly shaped recess 235 formed in a backside of the cover plate 223, with a front face 251 of the receptacle abutting a rear face 253 of the cover plate. The interface of the rib 233 and recess 235 prevent water from intruding into the receptacle opening 237.

Figure 16:
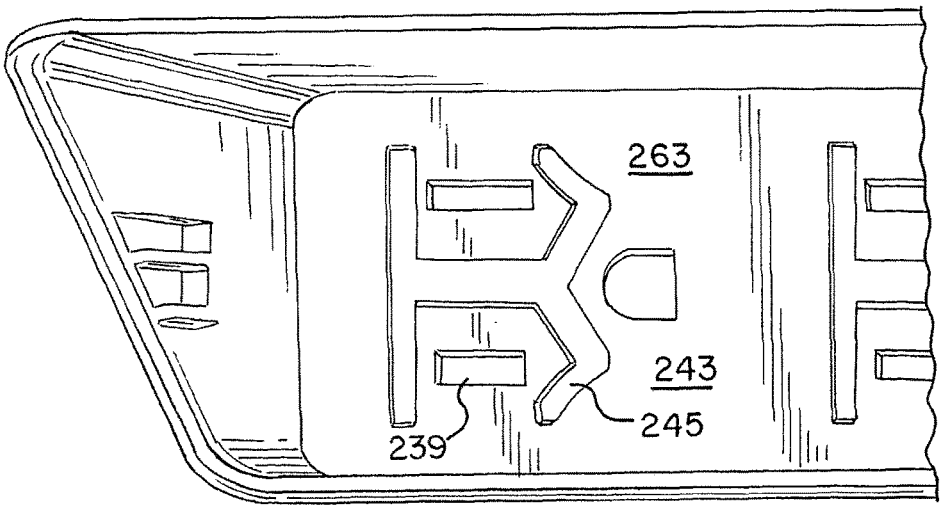
FIG. 16 is a partial interior view of the rear surface of a face plate.
Figure 17:
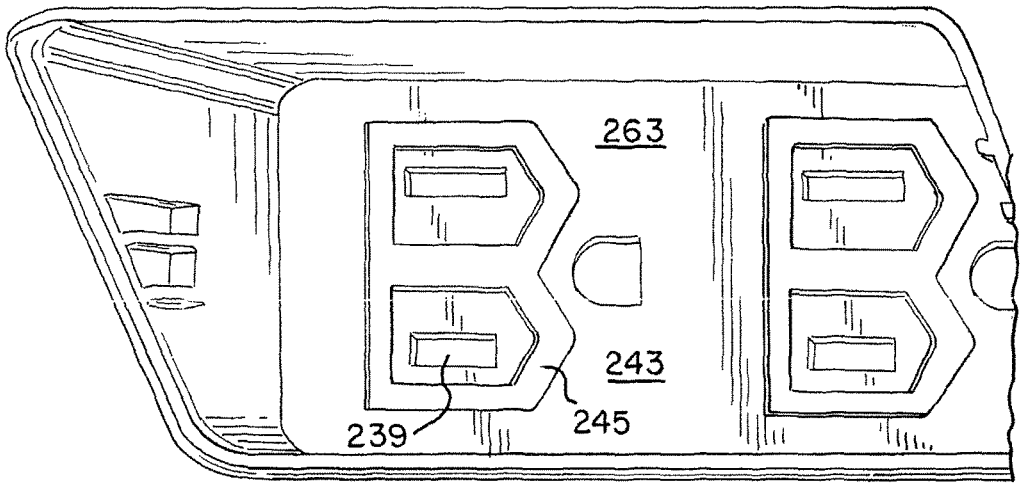
FIG. 17 is a partial interior view of the rear surface of an alternative embodiment of a face plate.
Figure 19:
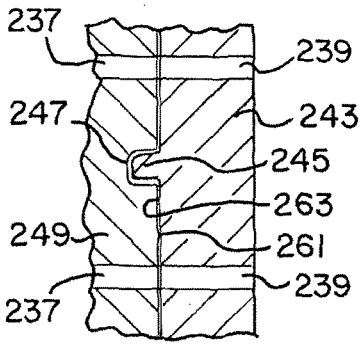
FIG. 19 is a cross-section view showing the interface between an alternative embodiment of a power receptacle and cover plate.

In an alternative embodiment, shown in FIGS. 16, 17 and 19, the backside of the cover plate 243 is configured with a rib 245, which may surround two or more sides of the openings 239 as shown in FIG. 16, or may surround the entirety of the openings a shown in FIG. 17. As shown in FIG. 19, the rib 245 is received in a recess 247 formed in a face of the power receptacle 249, with a face 261 of the receptacle abutting a rear surface 263 of the cover plate. In this embodiment, the face 261 of the receptacle defines the forwardmost surface of the receptacle.

Referring back to FIGS. 3A-3D and 10A-12B, the mounting frame 130 may include a peripheral outer lip 306 extending laterally in the plane of the work surface 104. The peripheral outer lip 306 may be integrally formed as part of the mounting frame 104 by injection molding techniques or other suitable manufacturing processes. The peripheral outer lip 306 may be formed at right angles to a downwardly depending aperture border 310, which may also be integrally formed as part of the mounting frame 104.

Preferably, the aperture border 310 fits snugly within the aperture 136 formed in the work surface 104, and the peripheral outer lip 306 supports the mounting frame 130 on the surface of the work surface. The mounting frame 130 may be secured to the work surface 104 by different suitable methods, such as the aforementioned snug fit or mechanical fasteners extending through small holes 320 in the peripheral outer lip 306 and extending into the material forming the work surface 104. In another embodiment, the mounting frame 130 may be secured to the work surface 104 by mechanical fasteners extending through small holes 324 in the aperture border 310, which may extend into the thickness of the material forming the work surface 104.

As shown in FIGS. 3A and 3B, the mounting frame 130 may include a plurality of integrally formed power cord grommets 330 through which power cords may be routed and held firmly in place. Preferably, this provides a convenient entry point for the power cord when plugged into the power receptacles when the pivoting receptacle assembly 202 is in the closed or second orientation. Although such grommets are shown at the corners of the mounting frame, additional grommets (or fewer) may be included. FIGS. 5A and 5B show the mounting frame 130 and the flat face plate 210 in the closed orientation, and particularly showing the cord grommets 330.

FIGS. 5C-5E show the power receptacle module 102 in its pivoting capacity. The pivoting receptacle assembly 202 may include oppositely disposed and downwardly depending sidewalls 510, which are preferably integrally formed with the flat face plate 210. Alternatively, the flat face plate 210 may be separate and apart from the pivoting receptacle assembly 202 and fastened to the pivoting receptacle assembly 202 by mechanical fasteners or chemical adhesive.

The receptacle module is mounted to the mounting frame with a pivot member, including for example a hinge pin 620. The hinge pin 620 may be integrally formed with either of the module or the mounting frame and engage an opening in the other, or the hinge pin may be formed as a separate member.

Each sidewall 510 may include an arcuate groove 520 formed partially through the respective sidewall. The groove 520 may cooperate with a spring-biased button 526, which may be disposed at the end of a molded arm 530. The molded arm 530 may apply spring pressure to urge the button 526 against the arcuate groove so that the pivoting receptacle assembly 202 may remain in a stationary position between the open and closed configurations without the need for the user to physically contact the pivoting receptacle assembly. This also prevents the pivoting receptacle assembly 210 from inadvertently "slamming" from the open position to the closed position when urged by the user.

To maintain the pivoting receptacle assembly 202 in the open and closed position, respectively, the button 526 may cooperate with a corresponding recess 540 formed at both ends of the arcuate groove 520, with the button defining an indexing member. Because the molded arm 530 provides a spring-like stiffness, once the pivoting receptacle assembly 202 is moved to the desired position (whether open or closed), the button is urged into the recess 540 to essential lock the pivoting receptacle assembly 202 in place. Slight hand pressure by the user against the face plate 210 is sufficient to overcome the spring force of the molded arm 530 and dislodge the button 526 from the recess 540, to effect placing the pivoting receptacle assembly 210 in the opposite orientation.

In some embodiments, a bumper or cushion 544 may be disposed on a back wall 542 of the pivoting receptacle assembly 202. The back wall 542 is preferably integrally formed with, and connects to, the downwardly depending side walls 510, to provide strength and structural integrity. The cushion may provide a "stop" and reduce any noise when the pivoting receptacle assembly 202 in moved to the closed orientation. The bumper may be configured to contact an underside portion of the work surface 104 to provide the mechanical "stop" in the closed orientation.

Figure 6A:
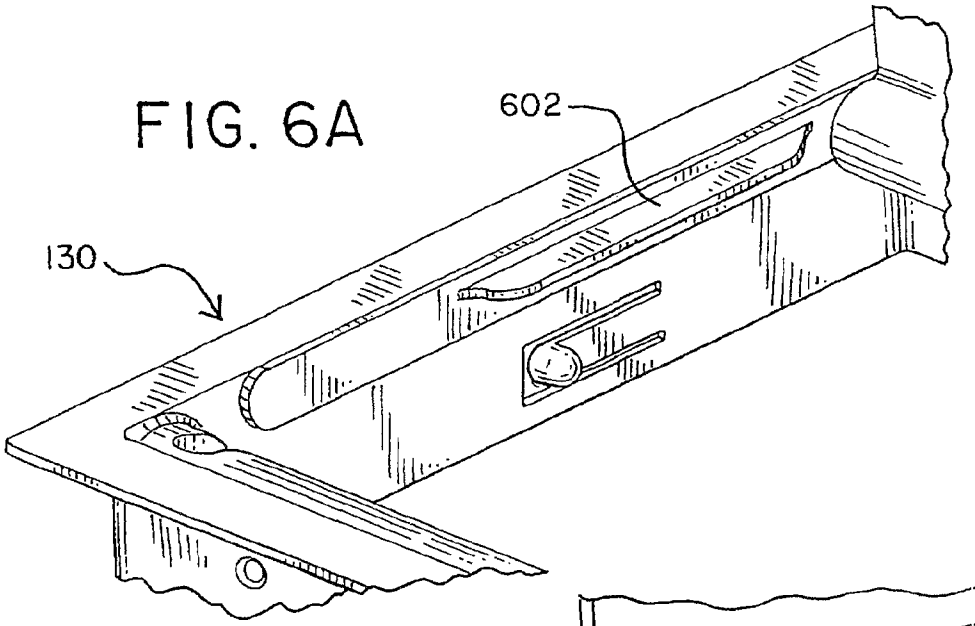
FIGS. 6A-6B show a retainer or projection on the mounting frame.
Figure 6B:
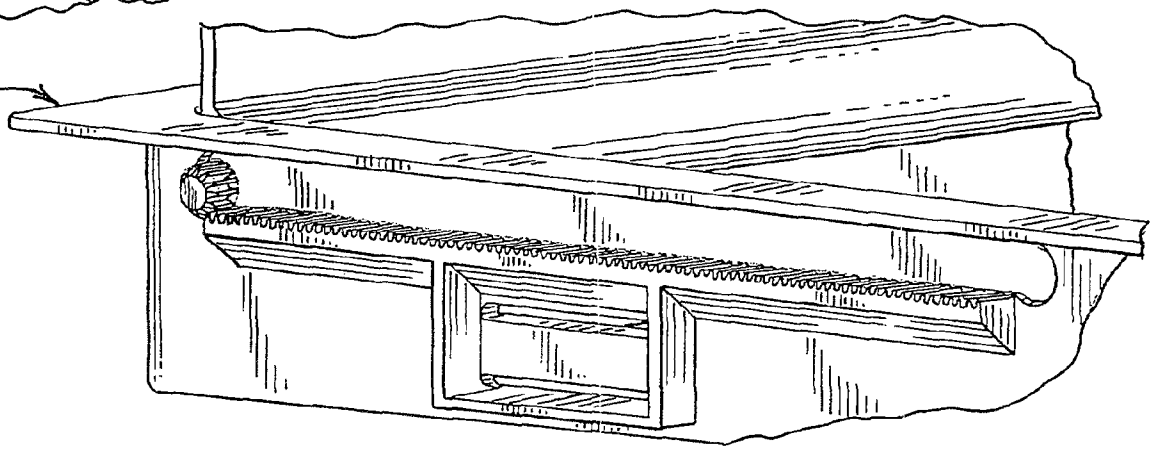

Alternatively, FIG. 6A shows a retainer or inwardly directed projection 602 disposed along an inside peripheral edge of the mounting frame 140. The retainer may provide a mechanical stop when a forward bottom surface of the face plate 210 contacts the retainer 602.

Figure 7B:
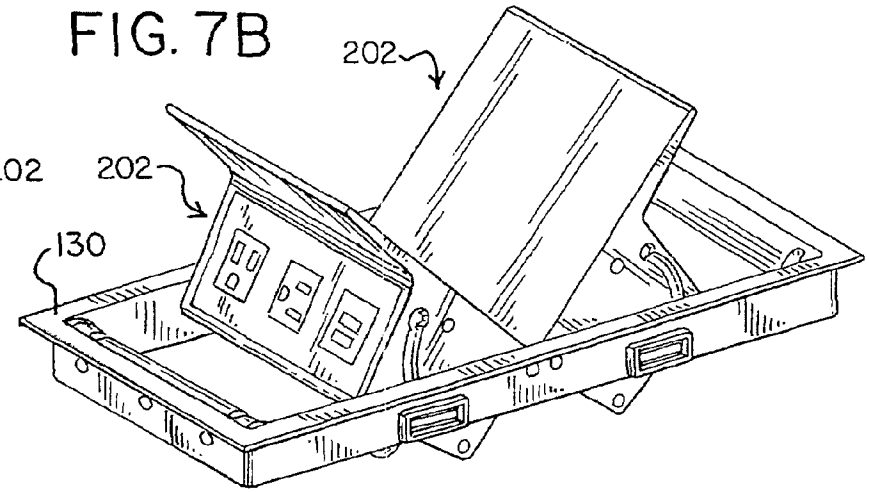
Figure 7C:
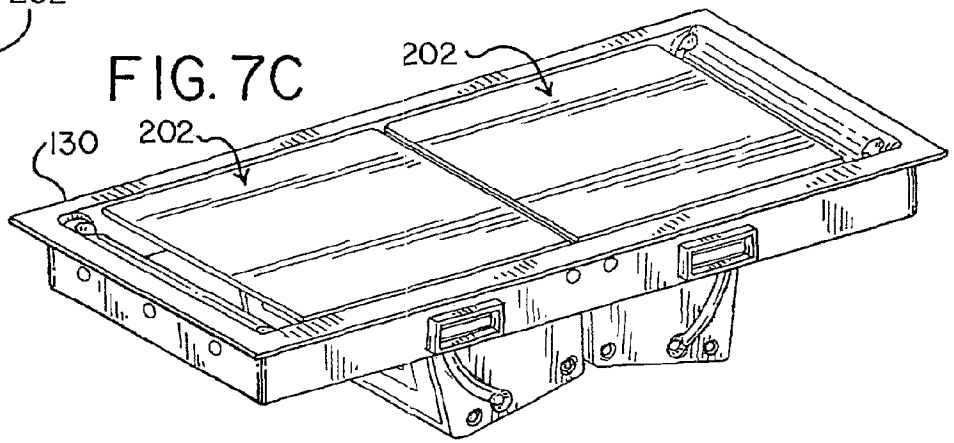
Figure 7A:
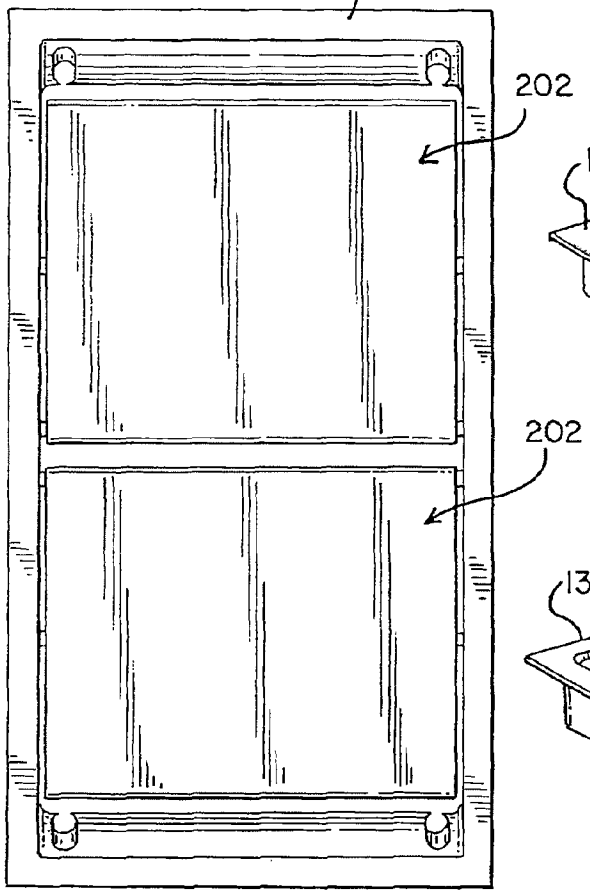
Figure 8A:
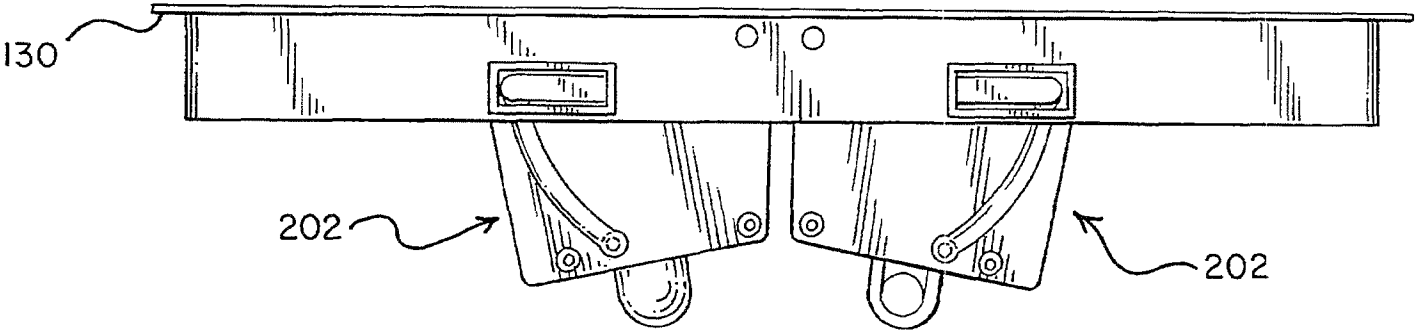
Figure 8B:
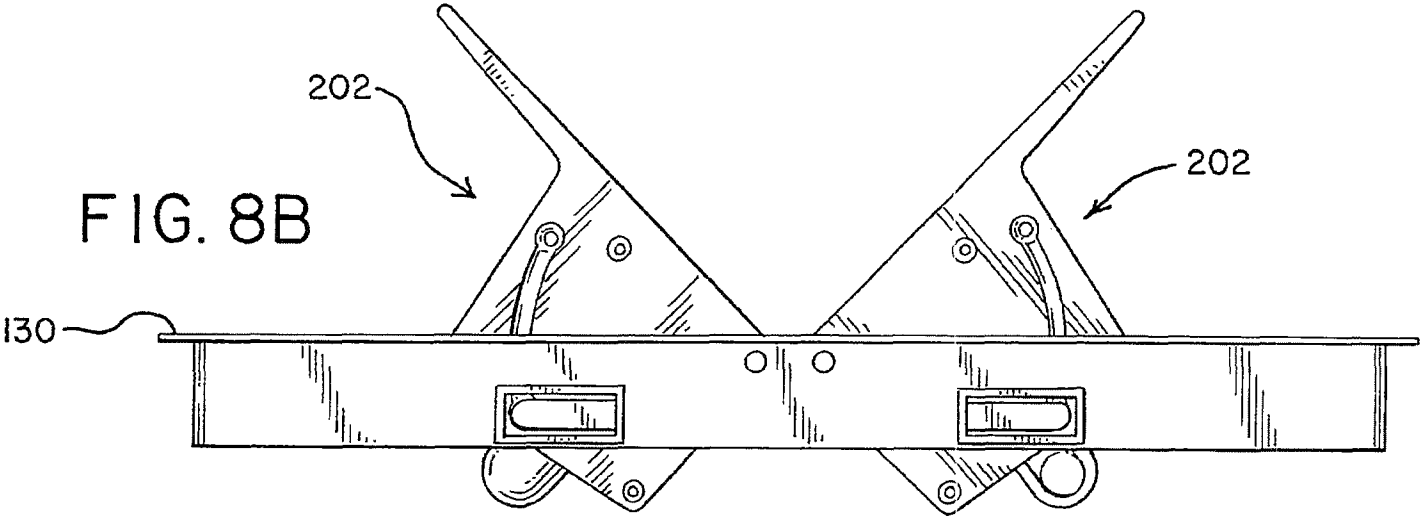

FIGS. 7A-7C shown the mounting frame 130 configured to pivotally retain two pivoting receptacle assemblies 202 in a back-to-back mounting configuration. FIG. 7B shows the back-to-back pivoting receptacle assemblies 202 in the open configuration, while FIG. 7C shows the back-to-back pivoting receptacle assemblies 202 in the closed configuration. Preferably, each pivoting receptacle assembly 202 is identical, but may be presented as a physical mirror image. FIGS. 8A-8C show a side elevational view of the back-to-back pivoting receptacle assemblies 202.

Referring to FIGS. 11A-12B, the pivoting receptacle assembly is pivotally mounted to the mounting frame with a pivot member 620. In one embodiment, the pivot member extends from a side portion of the mounting frame and the receptacle assembly includes an opening 603 shaped to receive the pivot member 620, which defines a pivot axis of the assembly relative to the mounting frame and worksurface. The assembly further includes an indexing member 605 disposed between the receptacle assembly and the mounting frame, the indexing member maintains the receptacle assembly in the second and third orientations. The indexing member is configured as a detent, shown as a button, disposed on one of the receptacle assembly or mounting frame and releasably engaging the other of the receptacle assembly or mounting frame. In the embodiment shown in FIGS. 11A-12B, the detent 605 is disposed on the receptacle assembly, although the positions are easily interchangeable. The detent releasably engages the mounting frame at a first opening 607 when the receptacle assembly is in the second orientation and releasably engages the mounting frame at a second opening 609 when the receptacle assembly is in the third orientation. It should be understood that more than two openings may be provided as desired to provide different engagement positions corresponding to predetermined orientations of the module. The mounting frame also includes a stop 611 positioned to engage a bottom of the face plate 210 when the receptacle assembly is in the first orientation.

To increase aesthetic appeal and user convenience, the face plate 210 or the mounting frame may include one or more illumination sources, such as LEDs, or conventional incandescent lighting, to provide backlighting. The illumination source in one embodiment is configured as an array of LEDs positioned in the rear of the inside of the housing, but in front of any internal wiring to avoid shadows. Such backlighting may be controlled by a proximity sensor 197 configured to turn on the illumination sources when activated by a hand of a user. The proximity sensor may be located by the face of the receptacles. Such proximity lighting activation is useful when a room is particularly dark, and when a user wishes to plug a device into the power receptacles 220, such as when a presentation is being given in a room with lights off. The illumination sources may be included in each pivoting receptacle assembly 202, whether in the single or the back-to-back configuration.

Figure 13:
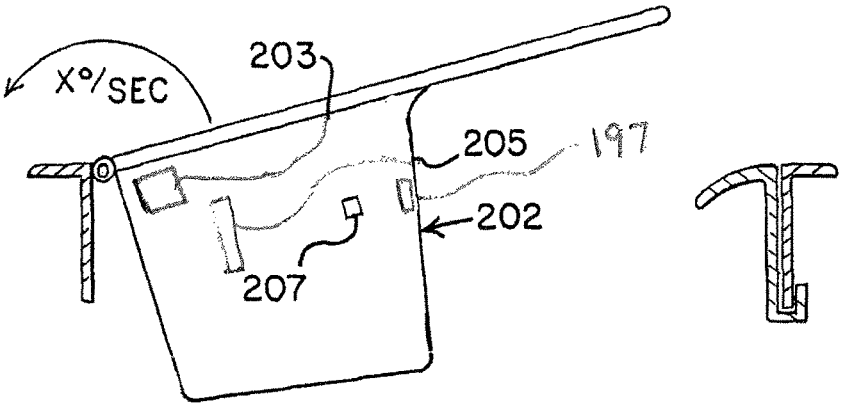
FIG. 13 is a side view of a power receptacle module being rotated.
Figure 14:
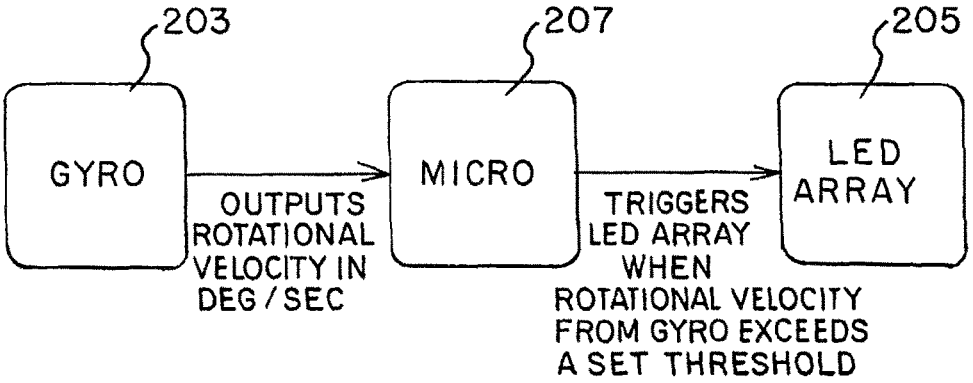
FIG. 14 is a schematic diagram illustrating control of a light source in the power receptacle module.

Referring to FIGS. 13 and 14, an alternative embodiment of an activation device for an illumination source 205 includes a gyroscope sensor 203. The gyroscope sensor is located on the moveable receptacle assembly, and in one embodiment close or adjacent to the axis of rotation. One suitable sensor is a low power, low noise, 3-axis angular rate sensor, such as the MAX21000 gyroscope available from Maxim Integrated, San Jose Calif. The gyroscope sensor is coupled to a microcontroller 207, such as a Pic® Microcontroller, which monitors the rotational velocity output of the gyroscope sensor. As such, when a user opens or pivots the receptacle assembly 202, the sensor 203 sense the rotational velocity. When the microcontroller 207 registers a velocity that exceeds a predetermined threshold, e.g., a rotational velocity measured in degrees/second, the microcontroller sends a signal to turn on the illumination source to provide the backlighting. In one exemplary embodiment, the rotational velocity is 10 degrees/second.

Figure 9B:
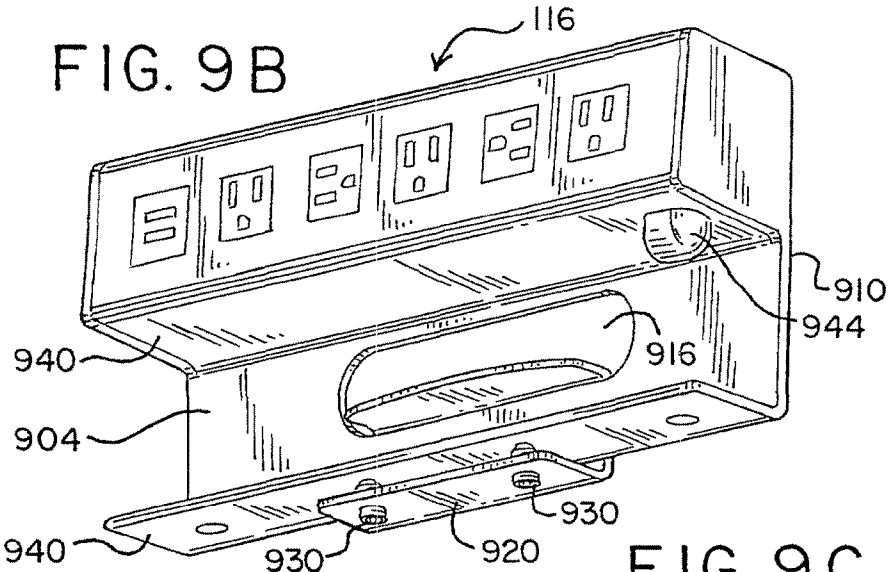
FIGS. 9A-9C show clamp-on or upright power receptacle module.
Figure 9C:
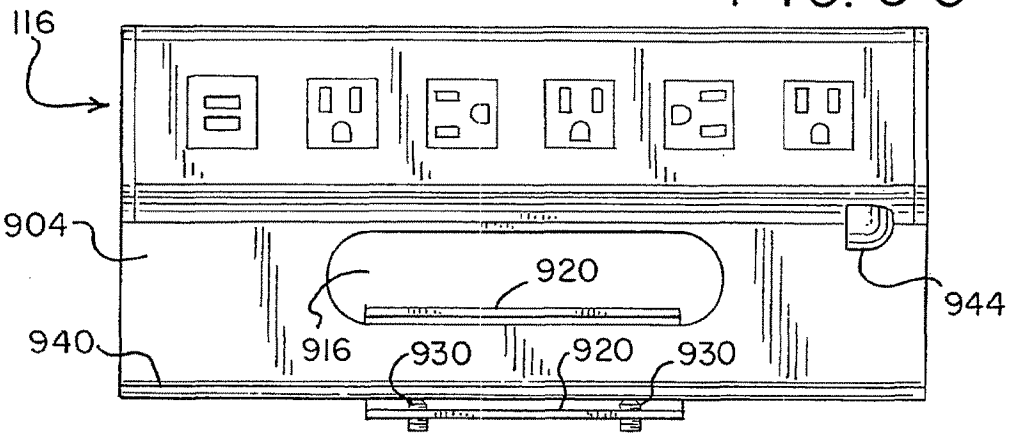
Figure 9A:
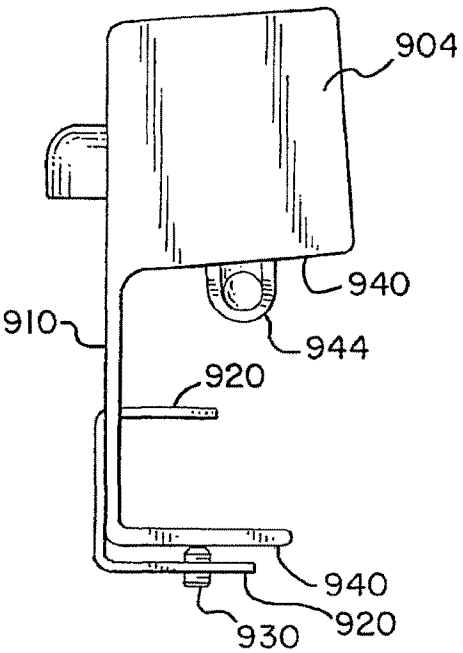

FIGS. 9A-9C shows the upright power receptacle module 116 initially described with respect to FIG. 1A. The power receptacle module 116 is this configuration does not pivot, but instead, is mounted to an edge of the work surface 104. The power receptacle module 116 includes an upright receptacle assembly 902, which may have the similar configuration as the pivoting receptacle assembly 202 of FIG. 2, but in this configuration, omits components and structure that permit pivoting. The upright receptacle assembly 902 may be coupled to or integrally formed with an upright mounting frame 904. A rear portion 910 of the upright mounting frame 904 may be substantially flush with an edge of the work surface 104, as shown in FIG. 1B. An aperture 916 in the mounting frame permits power cords to pass therethrough. A bracket 920 is configured to fixedly mount the upright mounting frame 904 to the work surface 104 using one or more tightening screws, which urges a bottom surface 940 of the upright mounting frame 904 against the top surface of the work surface 104. Rubber bumpers 944 may cushion and/or protect the top surface of the work surface 104.

Although the invention has been described with respect to various system and method embodiments, it will be understood that the invention is entitled to protection within the full scope of the appended claims.

The invention claimed is:

1. A power receptacle module for a work surface, comprising:

a mounting frame configured to be received within an aperture in the work surface;

a pivoting receptacle assembly pivotally mounted in the mounting frame and configured to pivot between a first orientation, a second orientation, and a third orientation relative to the mounting frame;

the pivoting receptacle assembly having a flat face plate and a plurality of power receptacles fixedly mounted below the flat face plate;

wherein when the pivoting receptacle assembly is in the first orientation, the flat face plate is flush with a top surface of the work surface, and the plurality of power receptacles are hidden below the work surface;

wherein when the pivoting receptacle assembly is in the second orientation, the flat face plate is disposed at an acute angle relative to the work surface, and the plurality of power receptacles are exposed; and wherein when the pivoting receptacle assembly is in the third orientation, the flat face plate is disposed at an obtuse angle relative to the work surface, and the plurality of power receptacles are exposed above the work surface.

2. The module of claim 1, wherein the plurality of power receptacles are AC power receptacles.

3. The module of claim 1, wherein the plurality of AC power receptacles are arranged in juxtaposed spaced relation to each other to maximize a number of power cords, transformer modules, and/or international-standard plugs, received therein.

4. The module of claim 1, wherein each AC power receptacle is rotated ninety degrees relative to an adjacent AC power receptacle.

5. The module of claim 1, wherein the plurality of power receptacles are DC or USB-type receptacles.

6. The module of claim 1, wherein the plurality of power receptacles are a combination of AC power receptacles and DC or USB-type receptacles.

7. The module of claim 1, wherein the face plate further includes one or more illumination sources configured to provide backlighting.

8. The module of claim 7, further including a proximity sensor configured to turn on the illumination sources when activated by a hand of a user.

9. The module of claim 7, further including a gyroscope configured to turn on the illumination sources when activated by a hand of a user.

10. The module of claim 1, wherein the mounting frame is configured to pivotally retain two pivoting receptacle assemblies in a back-to-back mounting configuration.

11. A power receptacle module for a work surface, comprising:

a mounting frame configured to be received within an aperture in the work surface;

a pivoting receptacle assembly pivotally mounted in the mounting frame and configured to pivot between a first orientation, a second orientation and a third orientation, relative to the mounting frame;

the pivoting receptacle assembly comprising a face plate and at least one power receptacle mounted below the face plate;

wherein when the pivoting receptacle assembly is in the first orientation, the face plate is substantially parallel with a top surface of the work surface, and the at least one power receptacle is hidden below the work surface;

wherein when the pivoting receptacle assembly is in the second orientation, the face plate is disposed at an acute angle relative to the work surface, and the at least one power receptacle is exposed above the work surface and is accessible from a first direction; and wherein when the pivoting receptacle assembly is in the third orientation, the face plate is disposed at an obtuse angle relative to the work surface, and the at least one power receptacle is exposed above the work surface and is accessible from a second direction opposite the first direction.

12. The module of claim 11 wherein the acute angle is approximately 45 degrees.

13. The module of claim 11 wherein the obtuse angle is approximately 135 degrees.

14. The module of claim 11 wherein the pivoting receptacle assembly is pivotally mounted to the mounting frame with a pivot member.

15. The module of claim 11 wherein the pivot member extends from a side portion of the mounting frame, and wherein the receptacle assembly comprise an opening shaped to receive the pivot member.

16. The module of claim 11 further comprising an indexing member disposed between the receptacle assembly and the mounting frame, the indexing member holding maintaining the receptacle assembly in the second and third orientations.

17. The module of claim 16 wherein said indexing member comprises a detent disposed one of the receptacle assembly or mounting frame and releasably engaging the other of the receptacle assembly or mounting frame.

18. The module of claim 17 wherein the detent is disposed on the receptacle assembly and releasably engages the mounting frame at a first opening when the receptacle assembly is in the second orientation and releasably engages the mounting frame at a second opening when the receptacle assembly is in the third orientation.

19. The module of claim 11 wherein the mounting frame comprises a stop positioned to engage the face plate when the receptacle assembly is in the first orientation.

20. The module of claim 11 wherein the at least one power receptacle comprises a plurality of AC power receptacles.

21. The module of claim 20 wherein the plurality of AC power receptacles are arranged in juxtaposed spaced relation to each other to maximize a number of power cords, transformer modules, and/or international-standard plugs, received therein.

22. The module of claim 21 wherein each AC power receptacle is rotated ninety degrees relative to an adjacent AC power receptacle.

23. The module of claim 11 wherein the at least one power receptacle comprises a DC or USB-type receptacle.

24. The module of claim 11 wherein the at least one power receptacle comprises a plurality of power receptacles comprising a combination of AC power receptacles and DC or USB-type receptacles.

25. The module of claim 11 wherein the face plate further includes one or more illumination sources configured to provide backlighting.

26. The module of claim 25 further including a proximity sensor configured to turn on the illumination sources when activated by a hand of a user.

27. The module of claim 25 further including a gyroscope configured to turn on the illumination sources when activated by a hand of a user.

* * * * *